US009981814B1

(12) United States Patent
Hong et al.

(10) Patent No.: US 9,981,814 B1
(45) Date of Patent: May 29, 2018

(54) TRANSMISSION DEVICE

(71) Applicant: FOXLINK IMAGE TECHNOLOGY CO., LTD., New Taipei (TW)

(72) Inventors: I Chuan Hong, New Taipei (TW); Lung Chen, New Taipei (TW)

(73) Assignee: FOXLINK IMAGE TECHNOLOGY CO., LTD., New Taipei (TW)

( * ) Notice: Subject to any disclaimer, the term of this patent is extended or adjusted under 35 U.S.C. 154(b) by 0 days. days.

(21) Appl. No.: 15/697,100

(22) Filed: Sep. 6, 2017

(51) Int. Cl.
*B65H 5/06* (2006.01)
*B65H 3/06* (2006.01)
*G03G 15/00* (2006.01)

(52) U.S. Cl.
CPC ..... *B65H 3/0669* (2013.01); *B65H 5/066* (2013.01); *G03G 15/602* (2013.01); *B65H 2403/42* (2013.01); *B65H 2403/50* (2013.01); *B65H 2403/722* (2013.01); *B65H 2403/942* (2013.01); *B65H 2513/412* (2013.01)

(58) Field of Classification Search
CPC ..... B65H 3/0669; B65H 2403/50; B65H 2403/722; B65H 2403/942; B65H 2513/412; B65H 2403/42; B65H 5/06; G03G 15/602
USPC ..... 271/10.04; 399/367
See application file for complete search history.

(56) References Cited

U.S. PATENT DOCUMENTS 8,292,288 B2 * 10/2012 Morinaga ..... B65H 3/0661 271/10.04
8,720,889 B2 * 5/2014 Samoto ..... B65H 5/062 271/266
8,998,195 B2 * 4/2015 Hong ..... B65H 5/26 271/186
8,998,208 B1 * 4/2015 Hong ..... B65G 13/06 271/314
9,751,705 B2 * 9/2017 Koda ..... B65H 3/0669
9,864,316 B2 * 1/2018 Ouchi ..... G03G 15/6529
2011/0198181 A1 * 8/2011 Tu ..... B65H 3/0669 192/20
2013/0256985 A1 * 10/2013 Samoto ..... B65H 5/062 271/225
2014/0061998 A1 * 3/2014 Kasashima ..... B65H 5/06 271/10.11
2015/0210491 A1 * 7/2015 Naniwa ..... B65H 5/36 358/498
2017/0366696 A1 * 12/2017 Koyanagi ..... H04N 1/1215

* cited by examiner

*Primary Examiner* — Jeremy R Severson
(74) *Attorney, Agent, or Firm* — WPAT, PC

(57) ABSTRACT

A transmission device includes a pickup roller assembly, a feeding roller assembly including a feeding shaft, a paper-out roller assembly including a paper-out shaft, a driving motor, a one-way drive gear module, a first transmission gear module, a second transmission gear module and a one-way clutch. The first transmission gear module includes a plurality of transmission gears disposed to two ends of the feeding shaft and two ends of the paper-out shaft. The second transmission gear module is engaged with one of the transmission gears mounted around one end of the feeding shaft. The one-way clutch disposed between the feeding shaft and the paper-out shaft, includes a first clutch gear, a second clutch gear, a third one-way clutch gear disposed between the first clutch gear and the second clutch gear, and a compression spring disposed to one end of the second clutch gear.

4 Claims, 6 Drawing Sheets

TRANSMISSION DEVICE

BACKGROUND OF THE INVENTION

1. Field of the Invention

The present invention generally relates to a transmission device, and more particularly to a transmission device assembled to an automatic sheet feeder.

2. The Related Art

With the improvement of softwares and hardwares, a conventional scanner has become one of basic equipments of many computer users. The conventional scanner is capable of scanning and inputting character and image materials into a computer, and processing the character and image materials. The character and image materials include paper documents, magazines, books, pictures and cards. The conventional scanner includes a scanning unit and a transmission device. When the paper documents are to be scanned in one way, the scanning unit is disposed under the horizontally placed paper documents, a motor, a gear assembly, a transmission belt and other transmission mechanisms of the transmission device are needed for driving the scanning unit to scan the paper documents. When the paper documents are to be scanned in another way, keep the scanning unit being without moving, the transmission device drives the paper documents to be scanned for achieving an image scan purpose. In order to increase a scan efficiency of the conventional scanner scanning the paper documents in the latter way, the conventional scanner is generally equipped with a current automatic sheet feeder.

The current automatic sheet feeder has a channel for transmitting the cards. The current automatic sheet feeders are generally equipped with different transmission devices to control an entrance and a scan of each of the cards. The transmission device is assembled to the current automatic sheet feeder. When one of the cards is being scanned, a tilt phenomenon will be caused at the time of the one of the cards entering the current automatic sheet feeder. Moreover, the current automatic sheet feeder includes a pickup device and a paper feeding roller, and the current automatic sheet feeder mostly uses at least two motors, or uses a clutch device, an electromagnetic valve device and so on to drive the pickup device and the paper feeding roller.

However, if the transmission device of the current automatic sheet feeder is equipped with more motors, a manufacturing cost of the transmission device will be increased, and a volume of the transmission device is hardly miniaturized.

In order to overcome the shortcomings described above, it is essential to improve the current automatic sheet feeder and the transmission device of the current automatic sheet feeder, so an innovative transmission device assembled to an automatic sheet feeder need be provided.

SUMMARY OF THE INVENTION

An object of the present invention is to provide a transmission device assembled to an automatic sheet feeder. The transmission device includes a pickup roller assembly assembled to the automatic sheet feeder, a feeding roller assembly assembled to the automatic sheet feeder, a paper-out roller assembly assembled to the automatic sheet feeder, a driving motor for driving the pickup roller assembly, the feeding roller assembly and the paper-out roller assembly, a one-way drive gear module driven by the driving motor, a first transmission gear module, a second transmission gear module disposed to one end of the pickup roller assembly, and a one-way clutch. The feeding roller assembly includes a feeding shaft and a feeding roller mounted around the feeding shaft. The paper-out roller assembly includes a paper-out shaft, and a paper-out roller mounted around the paper-out shaft. The one-way drive gear module includes a first one-way drive gear and a second one-way drive gear. The second one-way drive gear is mounted around one end of the feeding shaft, and the first one-way drive gear is mounted around the other end of the feeding shaft. The first one-way drive gear and the second one-way drive gear rotate in different directions to drive the feeding shaft to rotate. The first transmission gear module includes a plurality of transmission gears disposed to the two ends of the feeding shaft and two ends of the paper-out shaft. The first one-way drive gear is engaged with one of the transmission gears disposed to the other end of the feeding shaft. The driving motor drives the first transmission gear module to drive the first one-way drive gear so as to drive the feeding roller assembly to rotate in one direction. The driving motor drives the first transmission gear module to drive the paper-out roller assembly to rotate in different directions. The second transmission gear module is engaged with one of the transmission gears of the first transmission gear module mounted around the one end of the feeding shaft. The driving motor drives the first transmission gear module to drive the first one-way drive gear to rotate in the one direction to drive the feeding shaft to rotate in the one direction for driving the one of the transmission gears of the first transmission gear module mounted around the one end of the feeding shaft to drive the second transmission gear module so as to drive the pickup roller assembly to rotate in the one direction. The one-way clutch is driven by the driving motor and disposed to the one end of the feeding shaft and one end of the paper-out shaft, and is disposed between the feeding shaft and the paper-out shaft. The one-way clutch includes a first clutch gear, a second clutch gear, a third one-way clutch gear disposed between the first clutch gear and the second clutch gear, and a compression spring disposed to one end of the second clutch gear. The first clutch gear is engaged with one of the transmission gears of the first transmission gear module which is mounted around the one end of the paper-out shaft. The second clutch gear is engaged with the second one-way drive gear which is mounted around the one end of the feeding shaft. The compression spring presses the second clutch gear to make the second clutch gear avoid rotating when the third one-way clutch gear idles. The third one-way clutch gear is capable of being engaged with the second clutch gear to make the second clutch gear rotate in a single direction.

As described above, the driving motor rotates in a reverse direction to drive the first transmission gear module to drive the first one-way drive gear rotate in a forward direction so as to drive the feeding roller and the paper-out roller to rotate in the forward direction, the first transmission gear module drives the pickup roller assembly to rotate in the forward direction by the second transmission gear module, and the feeding roller and the paper-out roller rotate in the forward direction, one of the paper documents is conveyed successfully to be scanned. The driving motor rotates in the forward direction to drive the paper-out roller to rotate in the reverse direction by virtue of the first transmission gear module, the first one-way drive gear rotates in the reverse direction to make the first one-way drive gear idle to have no way of driving the feeding roller to rotate in the reverse direction, and the first clutch gear is driven to rotate in the forward direction by virtue of the second transmission gear module to bring one of the cards enter the automatic sheet feeder, the one of the cards is driven to arrive at the feeding roller which is without rotating, a rear end of the one of the cards pushes against the feeding roller for realizing a function of correcting a skew of the one of the cards, after the first clutch gear is driven rotate a set distance, a first protruding portion of the first clutch gear pushes against an inclined surface of the third one-way clutch gear to make the third one-way clutch gear engaged with the second clutch gear and drive the second clutch gear to rotate in the forward direction and drive the second one-way drive gear and the feeding shaft to rotate in the reverse direction so as to drive the first one-way drive gear rotate in the reverse direction to make the first one-way drive gear idle, the feeding roller and the paper-out roller rotate in the reverse direction to drive the one of the cards to continue being conveyed until the rear end of the one of the cards breaks away from the feeding roller, the driving motor stops rotating in the forward direction, then, the driving motor starts rotating in the reverse direction, the feeding roller and the paper-out roller are driven by the first transmission gear module to rotate in the forward direction so as to convey the one of the cards to proceed being scanned until the one of the cards completes being scanned, the one of the cards is transmitted out from a front end of the automatic sheet feeder. Moreover, the transmission device of the automatic sheet feeder is equipped with just the driving motor which is capable of simultaneously driving the pickup roller assembly, the feeding roller assembly and the paper-out roller assembly to avoid the transmission device using more motors, so a manufacturing cost of the transmission device will be decreased, and a volume of the transmission device is easily miniaturized.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
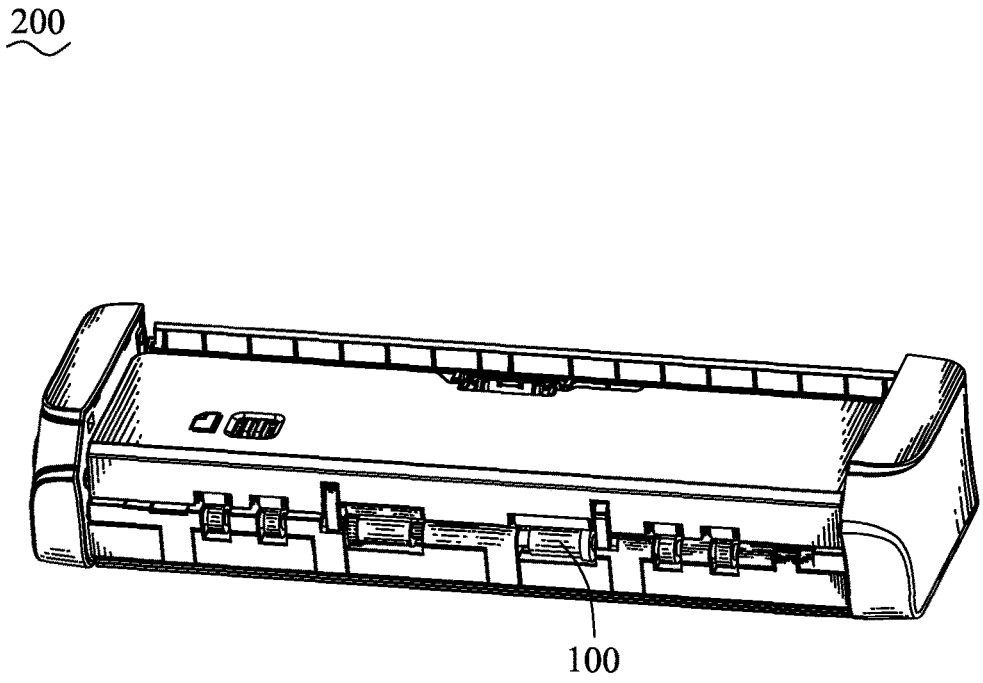
FIG. 1 is a perspective view of an automatic sheet feeder in accordance with a preferred embodiment of the present invention.
Figure 2:
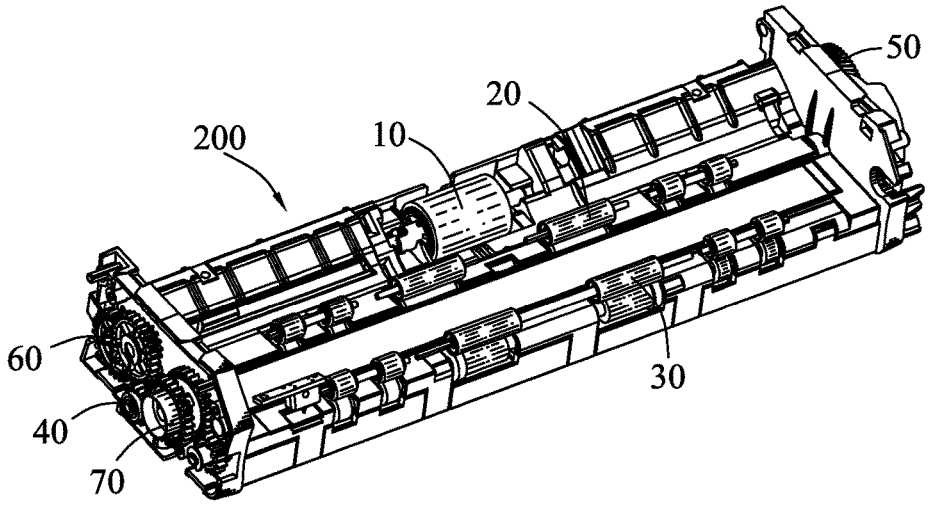
FIG. 2 is a partially perspective view of the automatic sheet feeder of FIG. 1.
Figure 3:
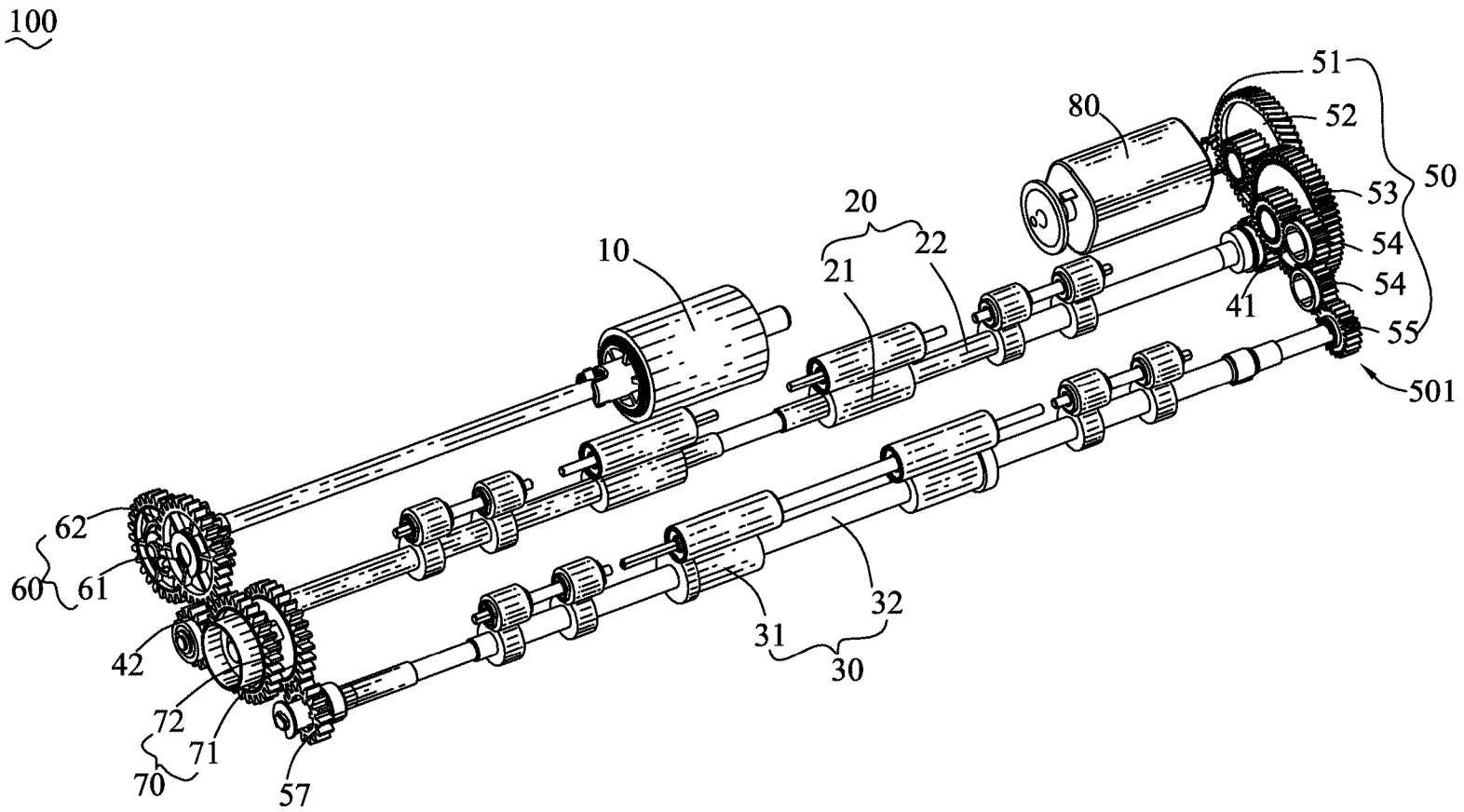
FIG. 3 is a perspective view of a transmission device assembled to the automatic sheet feeder of FIG. 1.
Figure 4:
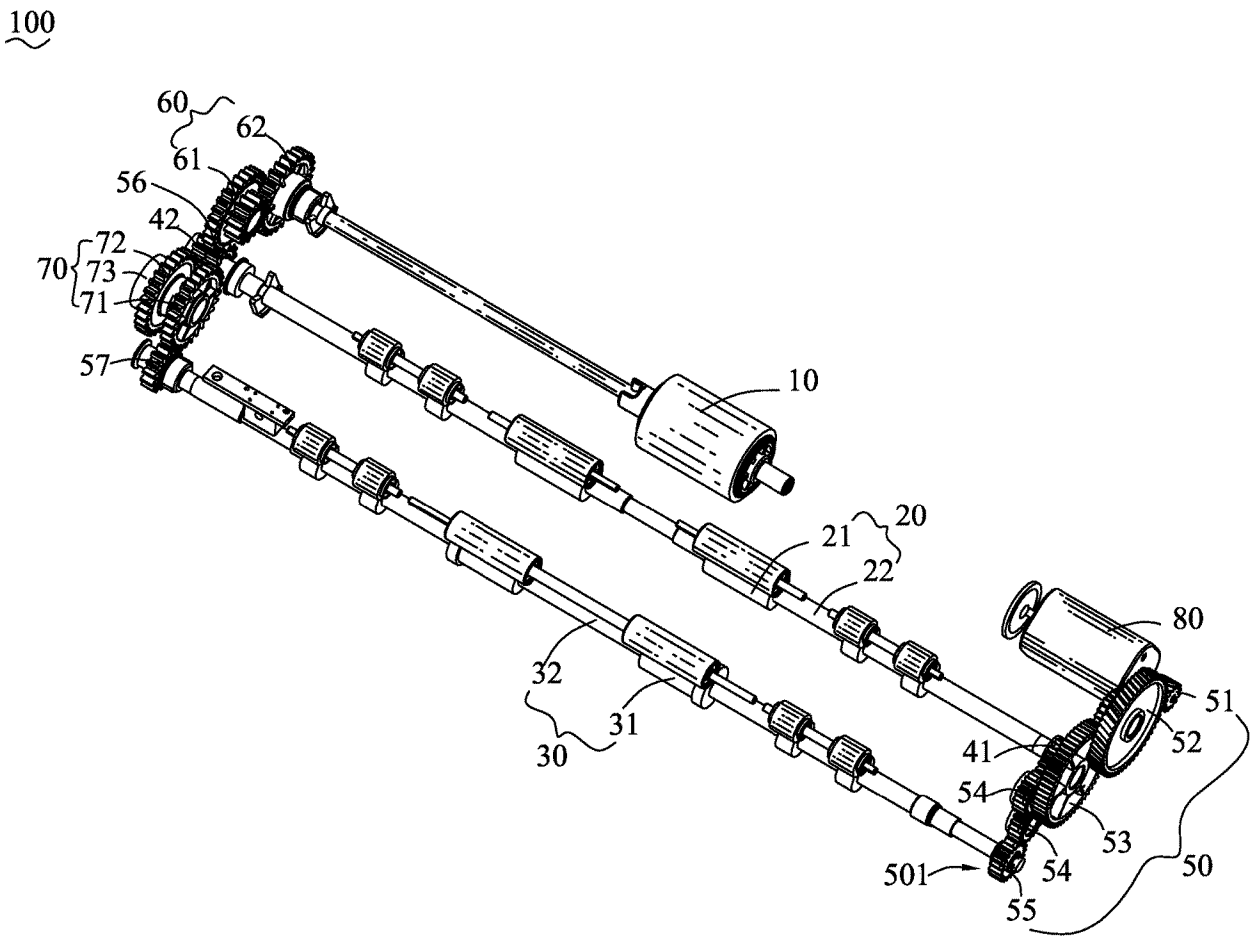
FIG. 4 is another perspective view of the transmission device assembled to the automatic sheet feeder of FIG. 1.
Figure 5:
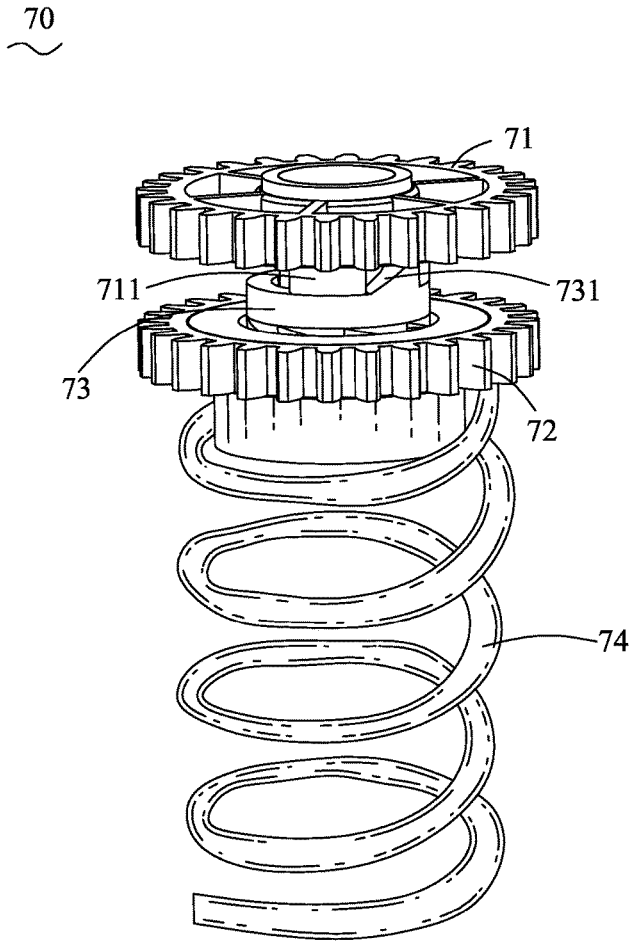
FIG. 5 is a perspective view of a one-way clutch of the transmission device assembled to the automatic sheet feeder of FIG. 1.
Figure 6:
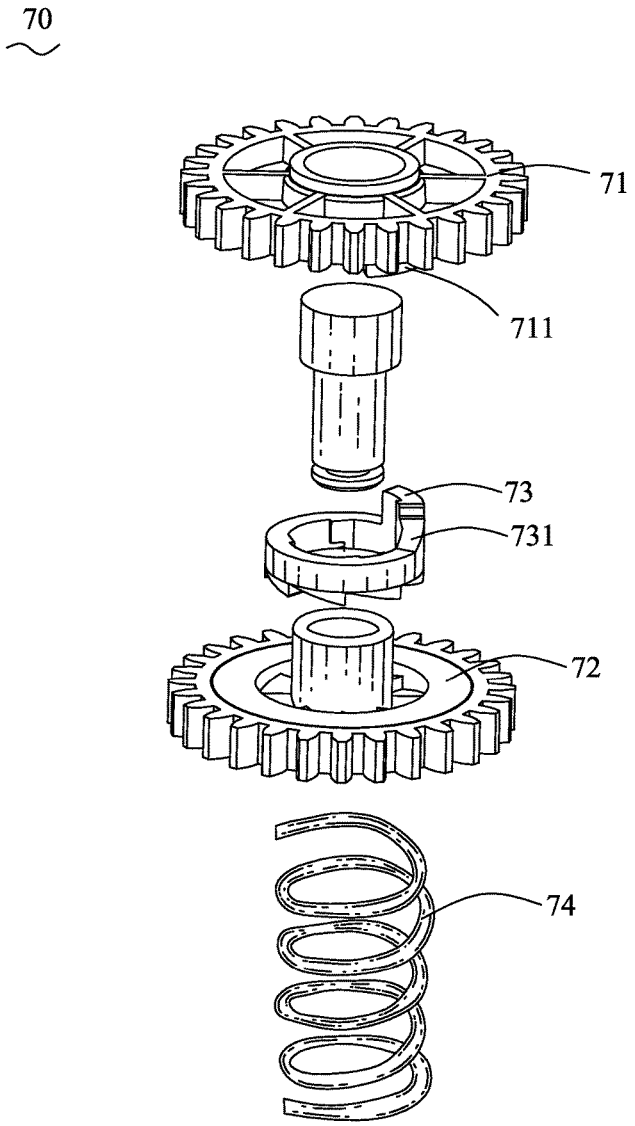
FIG. 6 is an exploded view of the one-way clutch of the transmission device assembled to the automatic sheet feeder of FIG. 5.

With reference to FIG. 1 to FIG. 3, a transmission device 100 in accordance with a preferred embodiment of the present invention is shown. The transmission device 100 is assembled to an automatic sheet feeder 200. The automatic sheet feeder 200 has functions of scanning paper documents (not shown) and cards (not shown). The transmission device 100 includes a pickup roller assembly 10, a feeding roller assembly 20, a paper-out roller assembly 30, and a driving motor 80 for driving the pickup roller assembly 10, the feeding roller assembly 20 and the paper-out roller assembly 30. In this preferred embodiment, a direction from a front end of the automatic sheet feeder 200 to a rear end of the automatic sheet feeder 200 is defined as a front-to-rear direction. When the driving motor 80 is seen from a left of the transmission device 100 of the automatic sheet feeder 200 shown in FIG. 3 to a right of the transmission device 100 of the automatic sheet feeder 200 shown in FIG. 3, a clockwise direction is defined as a forward direction, and an anticlockwise direction is defined as a reverse direction, so a clockwise rotation of the driving motor 80 is defined as a forward rotation of the driving motor 80, and an anticlockwise rotation of the driving motor 80 is defined as a reverse rotation of the driving motor 80. When automatic sheet feeder 200 scans each of the paper documents, each of the paper documents is fed into the automatic sheet feeder 200 from the rear end of the automatic sheet feeder 200 and is transmitted out of the automatic sheet feeder 200 from the front end of the automatic sheet feeder 200. When the automatic sheet feeder 200 scans each of the cards, each of the cards is fed into and transmitted out of the automatic sheet feeder 200 from the front end of the automatic sheet feeder 200.

Referring to FIG. 2 to FIG. 6, the feeding roller assembly 20 disposed between the pickup roller assembly 10 and the paper-out roller assembly 30, includes a feeding roller 21 and a feeding shaft 22. The feeding roller 21 is mounted around the feeding shaft 22.

The paper-out roller assembly 30 includes a paper-out roller 31 and a paper-out shaft 32. The paper-out roller 31 is mounted around the paper-out shaft 32.

The transmission device 100 further includes a one-way drive gear module 40, a first transmission gear module 50, a second transmission gear module 60, and a one-way clutch 70 disposed to one end of the feeding shaft 22 and one end of the paper-out shaft 32. The pickup roller assembly 10, the feeding roller assembly 20, the paper-out roller assembly 30, one-way drive gear module 40, the first transmission gear module 50, the second transmission gear module 60 and the one-way clutch 70 are assembled to the automatic sheet feeder 200 and driven by the driving motor 80.

The one-way drive gear module 40 includes a first one-way drive gear 41 and a second one-way drive gear 42. The second one-way drive gear 42 is mounted around the one end of the feeding shaft 22, and the first one-way drive gear 41 is mounted around the other end of the feeding shaft 22. When the first one-way drive gear 41 rotates in the forward direction, the first one-way drive gear 41 rotates in a single direction. When the first one-way drive gear 41 rotates in the reverse direction, the first one-way drive gear 41 idles. When the second one-way drive gear 42 rotates in the reverse direction, the second one-way drive gear 42 rotates in a single direction. When the second one-way drive gear 42 rotates in the forward direction, the second one-way drive gear 42 idles. So the first one-way drive gear 41 and the second one-way drive gear 42 rotate in different directions to drive the feeding shaft 22 to rotate.

The first transmission gear module 50 includes a plurality of transmission gears 501 disposed to the two ends of the feeding shaft 22 and two ends of the paper-out shaft 32. The first one-way drive gear 41 mounted around the other end of the feeding shaft 22 is engaged with one of the transmission gears 501 of the first transmission gear module 50 disposed to the other end of the feeding shaft 22. The driving motor 80 drives the first transmission gear module 50 to drive the first one-way drive gear 41 of the one-way drive gear module 40 so as to drive the feeding roller assembly 20 to rotate in one direction. The driving motor 80 drives the first transmission gear module 50 to drive the paper-out roller assembly 30 to rotate in different directions.

Specifically, the plurality of the transmission gears 501 of the first transmission gear module 50 includes a driving gear 51 connected with the driving motor 80, a first transmission gear 52, a second transmission gear 53, two third transmission gears 54 engaged with each other, a fourth transmission gear 55 fastened to and connected to the other end of the paper-out shaft 32, a fifth transmission gear 56 and a sixth transmission gear 57. The driving gear 51 is engaged with the first transmission gear 52. The second transmission gear 53 is engaged with the first transmission gear 52. The first one-way drive gear 41 is engaged with the second transmission gear 53. One of the two third transmission gears 54 is engaged with the second transmission gear 53, and the other third transmission gear 54 is engaged with the fourth transmission gear 55. The first one-way drive gear 41 is fastened to the feeding shaft 22. The fourth transmission gear 55 is fastened to the paper-out shaft 32. So the feeding roller 21 and the driving motor 80 rotate in opposite directions, and the paper-out roller 31 and the driving motor 80 rotate in the opposite directions. The fifth transmission gear 56 is fastened to and connected to the other end of the feeding shaft 22 around which the second one-way drive gear 42 is mounted. The sixth transmission gear 57 is fastened to and connected to the one end of the paper-out shaft 32.

The second transmission gear module 60 is disposed to one end of the pickup roller assembly 10, and is engaged with one of the transmission gears 501 of the first transmission gear module 50 mounted around the one end of the feeding shaft 22. The driving motor 80 drives the first transmission gear module 50 to drive the first one-way drive gear 41 to rotate in the one direction to drive the feeding shaft 22 to rotate in the one direction for driving the one of the transmission gears 501 of the first transmission gear module 50, namely the fifth transmission gear 56 mounted around the one end of the feeding shaft 22 to drive the second transmission gear module 60 so as to drive the pickup roller assembly 10 to rotate in the one direction. Specifically, the second transmission gear module 60 includes a seventh transmitting gear 61, and an eighth transmitting gear 62 engaged with the seventh transmitting gear 61. The seventh transmitting gear 61 is engaged with the fifth transmission gear 56. The eighth transmitting gear 62 is fastened to and connected to the one end of the pickup roller assembly 10.

Referring to FIG. 2 to FIG. 6, the one-way clutch 70 is disposed to the one end of the feeding shaft 22 and the one end of the paper-out shaft 32, and the one-way clutch 70 is disposed between the feeding shaft 22 and the paper-out shaft 32. The one-way clutch 70 includes a first clutch gear 71, a second clutch gear 72, a third one-way clutch gear 73 disposed between the first clutch gear 71 and the second clutch gear 72, and a compression spring 74 disposed to one end of the second clutch gear 72. The first clutch gear 71 is engaged with one of the transmission gears 501 of the first transmission gear module 50, namely the sixth transmission gear 57 which is mounted around the one end of the paper-out shaft 32. The second clutch gear 72 is engaged with the second one-way drive gear 42 which is mounted around the one end of the feeding shaft 22.

Specifically, the first clutch gear 71 is engaged with the sixth transmission gear 57 which is mounted around the one end of the paper-out shaft 32. The compression spring 74 presses the second clutch gear 72 to make the second clutch gear 72 avoid rotating when the third one-way clutch gear 73 idles. The third one-way clutch gear 73 is capable of being engaged with the second clutch gear 72 to make the second clutch gear 72 rotate in a single direction. The first clutch gear 71 has a first protruding portion 711 towards the second clutch gear 72. The third one-way clutch gear 73 has an inclined surface 731 towards the first clutch gear 71. When the first clutch gear 71 rotates until the first protruding portion 711 pushes against the inclined surface 731 of the third one-way clutch gear 73, the first clutch gear 71 is capable of driving the second clutch gear 72 to rotate in the same direction.

The driving motor 80 is capable of driving the first transmission gear module 50 in dual directions, when rotation directions of the first transmission gear module 50 are different, the first transmission gear module 50 drive the pickup roller assembly 10 to generate different rotation directions by virtue of the second transmission gear 53 driving the two third transmission gears 54. The driving motor 80 is capable of simultaneously driving the pickup roller assembly 10, the feeding roller assembly 20 and the paper-out roller assembly 30. The first one-way drive gear 41 and the second one-way drive gear 42 rotate in the different directions to drive the feeding shaft 22 to rotate in the different directions.

The driving motor 80 drives the first transmission gear module 50 to drive the first one-way drive gear 41 of the one-way drive gear module 40 to rotate in the one direction to drive the feeding shaft 22 of the feeding roller assembly 20 to rotate in the one direction, so that the second transmission gear module 60 is driven by the one of the transmission gears 501 of the first transmission gear module 50, namely the fifth transmission gear 56 mounted around the one end of the feeding shaft 22 to rotate in the one direction, and the pickup roller assembly 10 is driven to rotate in the one direction. Simultaneously, the driving motor 80 drives the first transmission gear module 50 to drive the paper-out shaft 32 to rotate in the one direction, and when the driving motor 80 drives the second transmission gear 53 of the first transmission gear module 50 to drive the first one-way drive gear 41 to rotate in the other direction, the first one-way drive gear 41 idle, at the moment, the feeding shaft 22 is without rotating, the driving motor 80 drives the first transmission gear module 50 to drive the paper-out shaft 32 to rotate in the other direction, so that after the first clutch gear 71 is driven by one of the transmission gears 501, namely the sixth transmission gear 57 mounted around the one end of the paper-out shaft 32 to rotate a set distance in the one direction, the third one-way clutch gear 73 is engaged with the second clutch gear 72 and drives the second clutch gear 72 to rotate in the one direction, and after the second one-way drive gear 42 is driven by the second clutch gear 72 to rotate a set distance in the other direction, the driving motor 80 changes a rotation direction, the driving motor 80 drives the first transmission gear module 50 to drive the feeding shaft 22 and the paper-out shaft 32 to rotate in the one direction.

Referring to FIG. 1 to FIG. 6, an action process of the transmission device 100 and the automatic sheet feeder 200 scanning the paper documents is described as follows.

When the automatic sheet feeder 200 starts working, one of the paper documents enters the automatic sheet feeder 200 from the rear end of the automatic sheet feeder 200. The driving motor 80 rotates in the reverse direction to drive the driving gear 51 to rotate in the reverse direction, the driving gear 51 drives the first one-way drive gear 41 and the fourth transmission gear 55 to rotate in the forward direction by virtue of the first transmission gear 52, the second transmission gear 53 and the two third transmission gears 54, at the moment, the first one-way drive gear 41 is in an engagement status, the first one-way drive gear 41 is engaged with the second transmission gear 53, the first one-way drive gear 41 and the fourth transmission gear 55 drive the feeding shaft 22 and the paper-out shaft 32 respectively to rotate in the forward direction to convey the one of the paper documents, the first one-way drive gear 41 and the fifth transmission gear 56 rotate in the forward direction, the fifth transmission gear 56 is engaged with the seventh transmitting gear 61 and drives the seventh transmitting gear 61 to rotate in the reverse direction, the seventh transmitting gear 61 is engaged with the eighth transmitting gear 62 and drives the eighth transmitting gear 62 to rotate in the forward direction, the eighth transmitting gear 62 drives the pickup roller assembly 10 to rotate in the forward direction, the pickup roller assembly 10 rotates in the forward direction to pick up the next paper document to and the next paper document enters the automatic sheet feeder 200 from the rear end of the automatic sheet feeder 200.

At the moment, the second one-way drive gear 42 is in a status of breaking away an engagement, the second one-way drive gear 42 breaks away from the second clutch gear 72, when the second one-way drive gear 42 rotates in the forward direction, the second one-way drive gear 42 rotates idles, so a torque is without being transmitted to the feeding shaft 22. The paper-out shaft 32 rotates in the forward direction to drive the sixth transmission gear 57 to rotate in the forward direction so as to drive the first clutch gear 71 to rotate in the reverse direction, at the moment, the first clutch gear 71 is in a status of breaking away an engagement, the first clutch gear 71 breaks away from the sixth transmission gear 57, so that the second clutch gear 72 will be without being driven to rotate, and simultaneously, the second clutch gear 72 is pressed by the compression spring 74, so the second clutch gear 72 is without rotating. The feeding shaft 22 and the paper-out shaft 32 rotate in the forward direction so as to convey the one of the paper documents out of the automatic sheet feeder 200 from the front end of the automatic sheet feeder 200.

Referring to FIG. 1 to FIG. 6, an action process of the transmission device 100 and the automatic sheet feeder 200 scanning the cards is described as follows.

When the automatic sheet feeder 200 starts working, one of the cards enters the automatic sheet feeder 200 from the front end of the automatic sheet feeder 200. The driving motor 80 rotates in the forward direction to drive the paper-out roller 31 to rotate in the reverse direction by virtue of the first transmission gear module 50 so as to convey the one of the cards starts entering the automatic sheet feeder 200 from the front end of the automatic sheet feeder 200, at the moment, the first one-way drive gear 41 is in a status of breaking away an engagement, the first one-way drive gear 41 breaks away from the second transmission gear 53, so the first one-way drive gear 41 is without driving the feeding shaft 22 to rotate, and the second clutch gear 72 is pressed by the compression spring 74, so the second clutch gear 72 is without rotating, and the second one-way drive gear 42 is without being driven.

The paper-out shaft 32 rotates in the reverse direction to drive the sixth transmission gear 57 to rotate in the reverse direction so as to drive the first clutch gear 71 to rotate in the forward direction by virtue of the second transmission gear module 60, at the moment, because the first protruding portion 711 is without contacting with the inclined surface 731, the first protruding portion 711 is incapable of pushing against the third one-way clutch gear 73, so that the first clutch gear 71 rotates in the forward direction to idle and is without driving the second clutch gear 72 to rotate. The one of the cards is continued being driven by the paper-out shaft 32 to arrive at the feeding roller 21 which is without rotating in the front-to-rear direction. At the moment, the first clutch gear 71 still idles, the feeding shaft 22 is still without rotating, the paper-out shaft 32 continues driving one of the cards to move in the front-to-rear direction, the one of the cards occurs a slip phenomenon to make a rear end of the one of the cards push against the feeding roller 21 for realizing a function of correcting a skew of the one of the cards.

After the first clutch gear 71 completes idling, the first protruding portion 711 of the first clutch gear 71 starts pushing against the inclined surface 731 of the third one-way clutch gear 73 so as to drive the second clutch gear 72 to rotate in the forward direction. The second clutch gear 72 is engaged with the second one-way drive gear 42 and drives the second one-way drive gear 42 to rotate in the reverse direction so as to drive the feeding shaft 22 to rotate in the reverse direction and the first one-way drive gear 41 to rotate in the reverse direction to make the first one-way drive gear 41 idle, namely when the first one-way drive gear 41 rotates in the reverse direction, the first one-way drive gear 41 is in the idling status. The feeding roller 21 and the paper-out roller 31 rotate in the reverse direction to drive one of the cards to continue being conveyed in the front-to-rear direction until the rear end of the one of the cards breaks away from the feeding roller 21, the driving motor 80 stops rotating in the forward direction, and the feeding shaft 22 stops rotating in the reverse direction. Then, the driving motor 80 starts rotating in the reverse direction, the feeding roller 21 and the paper-out roller 31 are driven by the first transmission gear module 50 to rotate in the forward direction so as to convey the one of the cards to proceed being scanned until the one of the cards completes being scanned, the one of the cards is transmitted out from the front end of the automatic sheet feeder 200.

As described above, the driving motor 80 rotates in the reverse direction to drive the first transmission gear module 50 to drive the first one-way drive gear 41 rotate in the forward direction so as to drive the feeding roller 21 and the paper-out roller 31 to rotate in the forward direction, the fifth transmission gear 56 of the first transmission gear module 50 drives the pickup roller assembly 10 to rotate in the forward direction by the second transmission gear module 60, and the feeding roller 21 and the paper-out roller 31 rotate in the forward direction, the one of the paper documents is conveyed successfully to be scanned. The driving motor 80 rotates in the forward direction to drive the paper-out roller 31 to rotate in the reverse direction by virtue of the first transmission gear module 50, the first one-way drive gear 41 rotates in the reverse direction to make the first one-way drive gear 41 idle to have no way of driving the feeding roller 21 to rotate in the reverse direction, and the first clutch gear 71 is driven to rotate in the forward direction by virtue of the second transmission gear module 60 to bring the one of the cards enter the automatic sheet feeder 200, the one of the cards is driven to arrive at the feeding roller 21 which is without rotating, the rear end of the one of the cards pushes against the feeding roller 21 for realizing the function of correcting the skew of the one of the cards, after the first clutch gear 71 is driven rotate the set distance, the first protruding portion 711 of the first clutch gear 71 pushes against the inclined surface 731 of the third one-way clutch gear 73 to make the third one-way clutch gear 73 engaged with the second clutch gear 72 and drive the second clutch gear 72 to rotate in the forward direction and drive the second one-way drive gear 42 and the feeding shaft 22 to rotate in the reverse direction so as to drive the first one-way drive gear 41 rotate in the reverse direction to make the first one-way drive gear 41 idle, the feeding roller 21 and the paper-out roller 31 rotate in the reverse direction to drive the one of the cards to continue being conveyed until the rear end of the one of the cards breaks away from the feeding roller 21, the driving motor 80 stops rotating in the forward direction, then, the driving motor 80 starts rotating in the reverse direction, the feeding roller 21 and the paper-out roller 31 are driven by the first transmission gear module 50 to rotate in the forward direction so as to convey the one of the cards to proceed being scanned until the one of the cards completes being scanned, the one of the cards is transmitted out from the front end of the automatic sheet feeder 200. Moreover, the transmission device 100 of the automatic sheet feeder 200 is equipped with just the driving motor 80 which is capable of simultaneously driving the pickup roller assembly 10, the feeding roller assembly 20 and the paper-out roller assembly 30 to avoid the transmission device 100 using more motors, so a manufacturing cost of the transmission device 100 will be decreased, and a volume of the transmission device 100 is easily miniaturized.

What is claimed is:

1. A transmission device assembled to an automatic sheet feeder, comprising:

a pickup roller assembly assembled to the automatic sheet feeder;

a feeding roller assembly assembled to the automatic sheet feeder, including a feeding shaft, and a feeding roller mounted around the feeding shaft;

a paper-out roller assembly assembled to the automatic sheet feeder, including a paper-out shaft, and a paper-out roller mounted around the paper-out shaft;

a driving motor for driving the pickup roller assembly, the feeding roller assembly and the paper-out roller assembly;

a one-way drive gear module driven by the driving motor, including a first one-way drive gear and a second one-way drive gear, the second one-way drive gear being mounted around one end of the feeding shaft, and the first one-way drive gear being mounted around the other end of the feeding shaft, the first one-way drive gear and the second one-way drive gear rotating in different directions to drive the feeding shaft to rotate;

a first transmission gear module including a plurality of transmission gears disposed to the two ends of the feeding shaft and two ends of the paper-out shaft, the first one-way drive gear being engaged with one of the transmission gears disposed to the other end of the feeding shaft, the driving motor driving the first transmission gear module to drive the first one-way drive gear so as to drive the feeding roller assembly to rotate in one direction, the driving motor driving the first transmission gear module to drive the paper-out roller assembly to rotate in different directions;

a second transmission gear module disposed to one end of the pickup roller assembly, and being engaged with one of the transmission gears of the first transmission gear module mounted around the one end of the feeding shaft, the driving motor driving the first transmission gear module to drive the first one-way drive gear to rotate in the one direction to drive the feeding shaft to rotate in the one direction for driving the one of the transmission gears of the first transmission gear module mounted around the one end of the feeding shaft to drive the second transmission gear module so as to drive the pickup roller assembly to rotate in the one direction; and a one-way clutch driven by the driving motor and disposed to the one end of the feeding shaft and one end of the paper-out shaft, and disposed between the feeding shaft and the paper-out shaft, the one-way clutch including a first clutch gear, a second clutch gear, a third one-way clutch gear disposed between the first clutch gear and the second clutch gear, and a compression spring disposed to one end of the second clutch gear, the first clutch gear being engaged with one of the transmission gears of the first transmission gear module which is mounted around the one end of the paper-out shaft, the second clutch gear being engaged with the second one-way drive gear which is mounted around the one end of the feeding shaft, the compression spring pressing the second clutch gear to make the second clutch gear avoid rotating when the third one-way clutch gear idles, the third one-way clutch gear being capable of being engaged with the second clutch gear to make the second clutch gear rotate in a single direction.

2. The transmission device as claimed in claim 1, wherein the plurality of the transmission gears of the first transmission gear module include a driving gear connected with the driving motor, a first transmission gear, a second transmission gear, two third transmission gears engaged with each other, and a fourth transmission gear fastened to and connected to the other end of the paper-out shaft, the driving gear is engaged with the first transmission gear, the second transmission gear is engaged with the first transmission gear, the first one-way drive gear is engaged with the second transmission gear, one of the two third transmission gears is engaged with the second transmission gear, and the other third transmission gear is engaged with the fourth transmission gear.

3. The transmission device as claimed in claim 1, wherein the plurality of the transmission gears of the first transmission gear module further include a fifth transmission gear and a sixth transmission gear, the fifth transmission gear is fastened to and connected to the other end of the feeding shaft around which the second one-way drive gear is mounted, the sixth transmission gear is fastened to and connected to the one end of the paper-out shaft, the second transmission gear module includes a seventh transmitting gear, and an eighth transmitting gear engaged with the seventh transmitting gear, the seventh transmitting gear is engaged with the fifth transmission gear, the first clutch gear is engaged with the sixth transmission gear.

4. The transmission device as claimed in claim 1, wherein the first clutch gear has a first protruding portion towards the second clutch gear, the third one-way clutch gear has an inclined surface towards the first clutch gear, when the first clutch gear rotates until the first protruding portion pushes against the inclined surface of the third one-way clutch gear, the first clutch gear is capable of driving the second clutch gear to rotate in the same direction.

* * * * *